US006220179B1

(12) United States Patent
Iskhakbayev

(10) Patent No.: US 6,220,179 B1
(45) Date of Patent: Apr. 24, 2001

(54) HEIGHT AND TILT ADJUSTABLE TABLE

(75) Inventor: Yuriy Iskhakbayev, Forest Hills, NY (US)

(73) Assignee: Lyudmila Gadayeva, Forest Hills, NY (US)

( * ) Notice: Subject to any disclaimer, the term of this patent is extended or adjusted under 35 U.S.C. 154(b) by 0 days.

(21) Appl. No.: 09/409,194

(22) Filed: Sep. 30, 1999

(51) Int. Cl.[7] ..... A47F 5/12
(52) U.S. Cl. ..... 108/6; 108/10
(58) Field of Search ..... 108/6, 10, 8, 9, 108/132, 1

(56) References Cited

U.S. PATENT DOCUMENTS

| | | | | |
|---|---|---|---|---|
| 1,859,456 | * | 5/1932 | Nestler | 108/10 X |
| 2,710,780 | * | 6/1955 | Lawes | 108/8 X |
| 3,640,228 | * | 2/1972 | Busse | 108/10 X |
| 3,988,021 | * | 10/1976 | Grover | 108/10 X |
| 4,148,520 | | 4/1979 | Miller . | |
| 4,354,437 | | 10/1982 | Logan . | |
| 4,502,394 | | 3/1985 | Veyhl . | |
| 4,508,305 | | 4/1985 | Johnson . | |
| 4,585,270 | | 4/1986 | Singer . | |
| 4,604,955 | | 8/1986 | Fleisher . | |
| 4,681,042 | * | 7/1987 | Roberts | 108/8 X |
| 4,833,998 | | 5/1989 | Everett . | |
| 5,007,673 | | 4/1991 | Cheng . | |
| 5,413,051 | * | 5/1995 | Tseng | 108/10 X |
| 5,495,811 | | 3/1996 | Carson . | |
| 5,497,706 | | 3/1996 | Yong . | |
| 5,562,052 | | 10/1996 | Glashouwer . | |
| 5,607,155 | | 3/1997 | Campbell . | |
| 5,913,271 | | 6/1999 | Lloyd . | |

* cited by examiner

*Primary Examiner*—Jose V. Chen
(74) *Attorney, Agent, or Firm*—Boris Leschinsky

(57) ABSTRACT

A table contains a top panel supported at opposite sides by a pair of telescopic columns and a system of flexible links providing tension between the top panel and the bottom base. Height adjustment between the TOP and BOTTOM positions is achieved by extending the telescopic columns until the engagement of the spring-loaded pins. Tensioning of the flexible links in the BOTTOM position is achieved by engaging a pulley with a barbed rod extending from the bottom base so that the slack in the flexible links is removed. Once in a TOP position, tilting may be achieved by releasing one of the flexible links from the top panel and engaging the pulley with the barbed rod as if in the BOTTOM position.

8 Claims, 2 Drawing Sheets

HEIGHT AND TILT ADJUSTABLE TABLE

BACKGROUND OF THE INVENTION

1.Field of the Invention

The present invention relates generally to a table with adjustable height and tilt. More particularly, the table of the present invention is capable of being adjusted to be at a lower height or at an upper height. At the upper height position, the tilt of the table can be switched between horizontal and inclined positions using tension links such as a chain, a cable, or a rope.

2. Description of the Prior Art

Adjustable tables are generally known in the prior art. One can differentiate between height adjustable tables and tilt adjustable tables although designs in which both parameters are adjustable are also known.

The need for height adjustability is well established in the prior art. In addition to various professional and industrial uses, in a common household situation, height adjustability is desirable to make the table usable comfortably by both adults and children. For a common situation of a young family with small children living in a small apartment with limited space, a universally adjustable table would allow for a variety of tasks to be performed by both adults and children, for which the table has to have at least two height positions. In addition, tilting of the table allows for additional convenient uses such as reading, drafting, playing games, etc. In a typical height adjustable table, the design incorporates some form of extending the four legs of the table upward following by fixing it in place.

Examples of such designs can be found in the following U.S. Patents. U.S. Pat. No. 5,562,052 by Glashouwer depicts a height adjustable table having telescoping legs with a limited number of spaced holes designed to receive removable lock elements so that the design has a number of fixed height positions. One limitation of this design is that the process of adjusting all four legs takes some time and thus is not adapted for quick switching back and fourth to change the function of the table in a household setting.

U.S. Pat. No. 5,495,811 by Carson depicts another variation of the height adjustable table in which telescoping legs are adapted to allow gradual adjustment of height. It has the same limitation as the previous patent.

U.S. Pat. No. 4,604,955 by Fleischer depicts a gear crank mechanism for gradual adjustment of the height of the table. Although free of the disadvantages mentioned above, the design is complex and therefore the table is heavy and best suited for supporting heavy objects such as video equipment.

Various tilting devices are known in the prior art and can be found for example in U.S. Pat. Nos. 4,508,305 by Johnson and 5,607,155 by Campbell. In most cases, these design contain provisions for fixing the tiltable upper surface of the table in place which requires tightening of some holding elements typically on both sides of the table. As indicated above, these designs are not easily adapted for frequent changing back and fourth and therefore have limited utility in a household setting.

An example of a table allowing for both height and tilt adjustment is shown in the U.S. Pat. No. 4,502,394 by Veyhl. Although it is believed to be highly desirable to be able to adjust both the height and the tilt of the table, this particular design is rather complex and requires many parts to function properly. As a result, it is believed to be heavy and not desirable or easily adaptable for a common use around the house.

The use of tension links as a structural element of a piece of furniture is also known in the prior art. A tension link may comprise a chain, a cable, a rope or another flexible element that can be tightened to provide tension between two strategic points of the design. Examples of such designs can be found in the following U.S. Pat. Nos. 5,913,271 by Lloyd; U.S. Pat. No. 5,497,706 by Yong; U.S. Pat. No. 5,007,673 by Cheng; U.S. Pat. No. 4,833,998 by Everett; U.S. Pat. No. 4,585,270 by Singer; U.S. Pat. No. 4,354,437 by Logan; and U.S. Pat. No. 4,148,520 by Miller.

These and other known devices of the prior art fail to address the important objective of the adjustable table of this type, namely to provide a design allowing for both height and tilt adjustment while minimizing the time and efforts needed to perform the adjustment and keeping the table design simple and light in weight.

The present invention is designed to address this objective and described in detail below.

SUMMARY OF THE INVENTION

Accordingly, it is an object of the present invention to overcome these and other drawbacks of the prior art by providing a novel height and tilt adjustable table allowing for quick change of position while maintaining the simplicity and low weight of the design.

It is another object of the present invention to provide a height and tilt adjustable table allowing for both adults and children use of the device.

It is a further object of the present invention to provide a height and tilt adjustable table containing flexible tension links.

Finally, it is another object of the invention to provide a table with removable storage tray.

According to the invention, most of the benefits derived from the tilt and height adjustment features of the table can be preserved if the table can be placed in one of extreme tilting or height positions and no intermediate position can be established. This principle can be illustrated for adult and child use of the table. Switching between extreme top and bottom positions is quite satisfactory for both adult and child uses and there is no need to fix the table half way in between the two extreme positions. Same can be said about tilt: switching the table from horizontal position to fully tilted provides most of the desired flexibility in use. At the same time, such limitation allows to simplify the design to a considerable extend which makes it both easy and fast to use as well as allows for a table design with small number of parts that are not heavy. This combination of features creates an inexpensive and yet quite universal table which becomes quite handy in a common household environment.

The table according to the invention contains a top flat panel supported by two telescopic columns positioned in their respective support bases rigidly attached to the bottom base of the table. When fully inserted, they define the lowest position of the table. The columns can be moved upwards from their support bases to a predetermined height which when fully extended defines the highest position of the table. A simple fixation elements are provided to fix the columns in both the lower and upper positions.

The attachment points between the telescopic columns and the top panel are hinged for tilt adjustment. A system of two flexible tension links each attached to the top panel in two points sufficiently far away from the column attachment points is provided. These tension links are needed to stabilize the position of the top panel in any of four possible positions: TOP-LEVELED; TOP-TILTED LEFT; TOP-TILTED RIGHT; and BOTTOM-LEVELED. Tensioning system for the flexible links is envisioned to make sure that the top panel is supported at least three points in any of the above mentioned positions.

A magnetically attached tray is also provided to keep writing instruments and alike next to the table and to prevent such small items from falling off the table when in tilted position. The tray may be simply removed off the table while the upper flat surface is not distorted by conventional tray attachment mechanisms.

For a better understanding of the invention, its operating advantages and the specific objects attained by its uses, reference should be made to the accompanying drawings and descriptive matter in which there is illustrated a preferred embodiment of the present invention.

BRIEF DESCRIPTION OF THE DRAWINGS

A more complete appreciation of the subject matter of the present invention and the various advantages thereof can be realized by reference to the following detailed description in which reference is made to the accompanying drawing in which.

DETAILED DESCRIPTION OF THE MOST PREFERRED EMBODIMENT OF THE INVENTION

Figure 2:
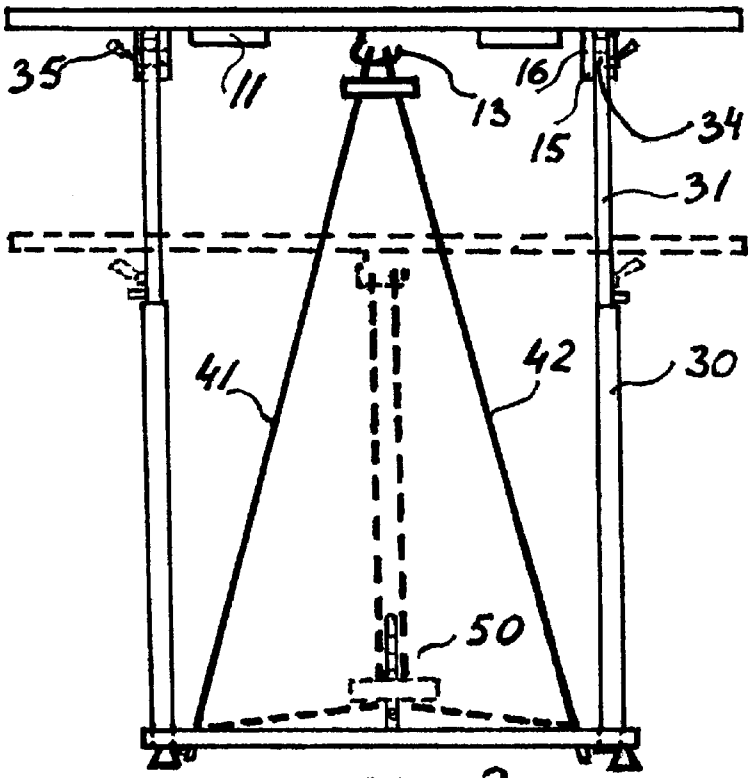
FIG. 2 is a front view of the table also in its TOP-LEVELED position, dashed lines illustrate same table in its BOTTOM-LEVELED position.

A detailed description of the present invention follows with reference to accompanying drawings in which like elements are indicated by like reference numerals.

Figure 1:
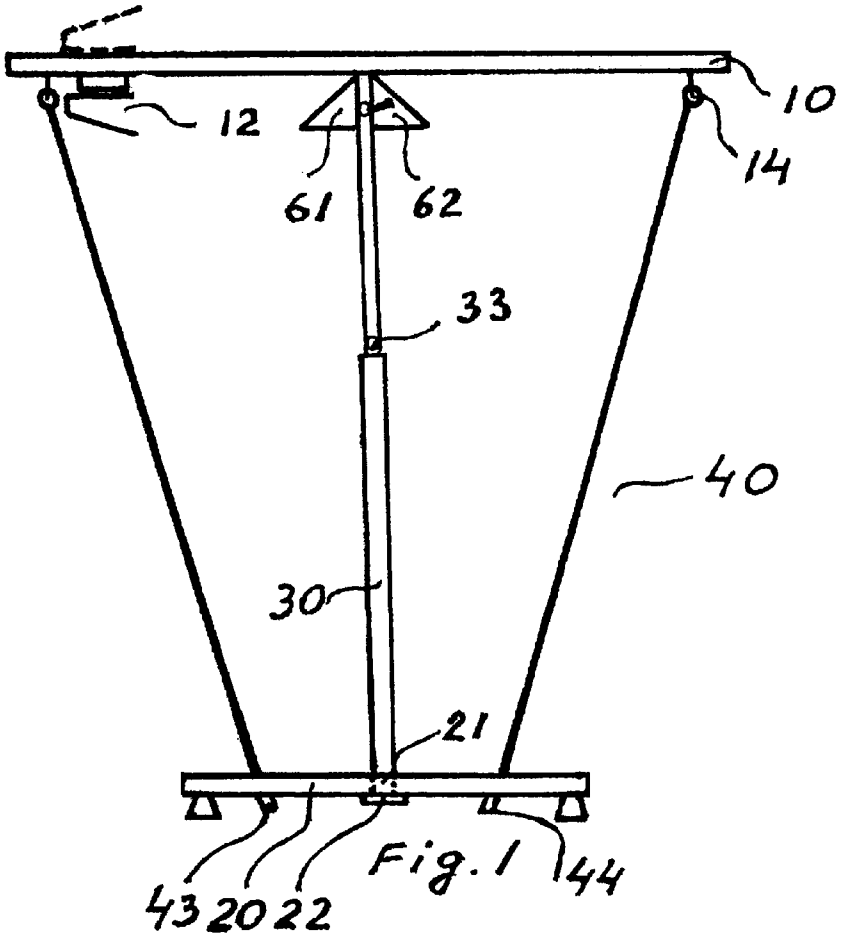
FIG. 1 is a side view of the table of the present invention in its TOP-LEVELED position.

The height and tilt adjustable table according to the present invention is shown on FIGS. 1 and 2 and contains a top generally flat panel (10) supported by two telescopic columns (31) and a system of two flexible tension links (40), all extending from the bottom base (20) of the table. Optionally, the bottom base (20) may be provided with four short legs of its own to lift it off the floor level and also provide room for the flexible links tensioning elements.

The top flat panel (10) contains two hooks (13) attached to the undersurface of the flat panel (10) in the midpoints of the opposite sides of the table. Hooks (13) serve to attach the respective loops of the flexible links system (40). If the table top flat panel is not square or rectangular but made in a round or oblong shape, then the hooks should be attached on the opposite sides of the table.

In addition, two ears (15) are attached to and extending down from the undersurface of the flat panel (10) at about midpoints of the two remaining opposite sides that are chosen to be away from the hooks (13). Each of these ears (15) contain a threaded hole (16) to accept a threaded pin (35) placed through a hole (34) at the upper part of the telescopic column (31). Hand tightening of the pair of pins (35) locks the height position and tilt of the table. Each ear (15) contains a pair of angles (61) and (62) so that when the top flat panel (10) is tilted to one side or the other, the corresponding angle (61) or (62) acts as a stop against the column (31) and prevents further tilting of the top panel (10) as will be discussed in more detail below. Other similar mechanisms can be readily used for the same purpose but not shown here as the use of these mechanisms would be readily apparent to one skilled in the art.

Each of the telescopic columns (31) extends from a respective support base (30) which in turn is attached to the bottom base (20) of the table. a spring-loaded stopper pin (33) is provided at the lower part of each column (31) such that upon extending the column (31) upwards the stopper pin (33) would pop out and prevent the lowering of the column (31) unless it is manually depressed by the user. Other similar anchor mechanisms can be used for the same purpose as can be easily understood by those skilled in the art without altering the nature of the present invention. Support bases (30) are removably placed through the holes (21) in seats (22) at the bottom base (20).

Flexible tension links system (40) serve to stabilize in tension the position of the top flat panel (10) which otherwise has only two points of support from telescoping columns (31). These links can be made of small ring chains, cables, ropes and other such flexible but stretch resistant materials. Flexible links system (40) consists of two branches—left (41) and right (42) as shown on FIG. 2. Each branch (41) and (42) contains an upper loop (14) to be placed through the hook (13) of the top panel (10). At the bottom, each branch (41) and (42) contains a pulling element (43)of the commonly known designs attached to the bottom base (20) and provided in order to take out any slack in the flexible tension link that may develop in the process of using the table.

Figure 3:
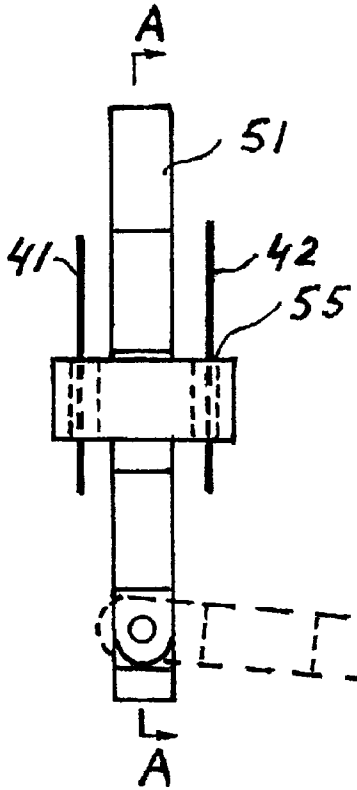
FIG. 3 is a detailed side view of the flexible link tensioning system in its operative position and as shown in dashed lines in its folded storage position.
Figure 4:
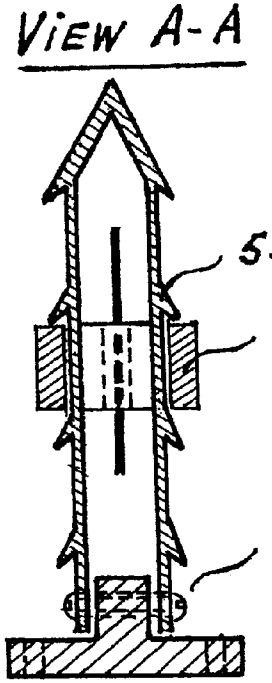
FIG. 4 is a detailed cross-section front view of the same system.

Tension mechanism (50) is provided approximately in the middle of the bottom base (20) and is designed to take out the extra length formed in the flexible tension links during the step of position adjusting of the table as will be explained in detail below. This mechanism consists of two main parts—the barbed rod (51) and the pulley (52) as shown in greater detail on FIGS. 3 and 4. The barbed rod (51) may be made from a polymer material and is equipped with a number of paired flexible barbs (53) extending downwards and designed to accept the pulley (52) as it is being moved downwards. The barbed rod (51) is equipped at the bottom with a hinge (54) to allow it to be lowered down along the bottom base (20) when not in use.

Figure 5:
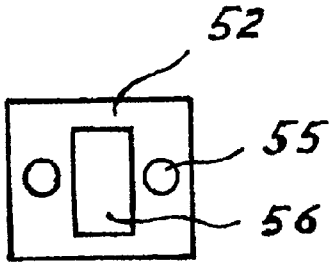
FIG. 5 is a top view of the sliding tensioning element of that system shown in FIG. 4 and FIG. 3.

The pulley (52) is designed to retain both tension link branches (41) and (42) through the side holes (55) and is shown in detail on FIG. 5. The central hole (56) is designed to allow sliding of the pulley (52) over the barbed rod (51) so that barbs (53) would retain the pulley (52) and prevent it from sliding upwards unless manually depressed and released by the user.

The table of the present invention is designed to have one of the four possible positions: TOP-LEVELED; TOP-TILTED LEFT; TOP-TILTED RIGHT; and BOTTOM-LEVELED. Starting from the first position, the following is the explanation of the steps needed to undertake to switch positions of the table.

In the TOP-LEVELED position, the telescopic columns (31) are fully extended upwards and are retained in this position by the stopper pins (33). Threaded pins (35) are fully tightened and the flexible links (40) are fully extended without engaging the tension mechanism (50). This position may be used by an adult user for a variety of common purposes.

Switching from the TOP-LEVELED position to the BOTTOM-LEVELED position is achieved by loosening the pins (35), depressing the pins (33) and lowering the top panel (10). Flexible tension links (40) form a large excessive length. To remove that length and bring them back into tension, the pulley (52) is lowered and engaged with the vertically extended barbed rod (51) until appropriate tension is achieved as shown schematically on FIG. 2. Pins (35) are tightened and the table is ready for a child user. The length of the flexible links (40) is chosen such that the barbed rod (51) allows to achieve tension in the flexible links once engaged with the pulley (52).

Reverse switching is achieved in the opposite manner. To loosen the pulley (52), the barbs (53) are manually depressed so that the flexible links (40) are released and the top flat panel can be raised to the top position.

Left or right tilted position is achieved by disengaging one of the loops (14) from a corresponding hook (13) and engaging the pulley (52) as described previously with the barbed rod (51) WITHOUT lowering the telescopic columns (31). Pairs of angles (61) and (62) are designed to prevent further tilting of the top panel (10) by engaging with respective telescopic columns (31).

Another improvement of the tilted table of the present invention is the removable tray (12) made from a magnetic material such as metal so that it can be magnetically attached to the edge of the top panel (10) when placed over the top panel (10) in its "se" position and while being retained by a magnet (11) positioned under the top panel (10). Two or more of these trays may be used as shown on FIG. 1. The tray is especially useful in a tilted position of the table for storing such items as writing instruments and alike as well as for using it as a stop edge for books, musical sheets, drawing paper and the like. When not in use, the tray may be removed from its position and placed for storage under the top panel (10) using the same magnets (11) for retention purposes. Alternately, trays (12) may be completely removed from the table as shown on FIG. 2. Magnetic attachment allows to have a perfectly flat top surface without disturbing attachment elements commonly present in tiltable tables.

The table of the present invention can be easily disassembled for storage. In that case, flexible links (40) are disengaged and removed, followed by loosening and removing of the pins (35) which liberates the top panel (10). Telescopic columns (31) then are fully inserted into their respective support bases (30) which in turn are removed from the seats (22) off the bottom base (20). Reassembly of the table is easily achieved in reverse order.

Although the present invention has been described with respect to a specific embodiment and application, it is not limited thereto. Numerous variations and modifications readily will be appreciated by those skilled in the art and are intended to be included within the scope of the present invention, which is recited in the following claims.

What I claim is:

1. A height and tilt adjustable table comprising:

a top panel having a first side, a second side, a third side opposite the first side, and a fourth side opposite the second side, each side having a respective first, second, third, and fourth midpoint, a bottom base, a first telescopic column extending from a first support base attached to said bottom base, said first column supporting said top panel via a first hinge at a point about said first midpoint, a second telescopic column extending from a second support base attached to said bottom base opposite said first support base, said second column supporting said top panel via a second hinge at a point about said third midpoint, said first and second telescoping columns having a fully extended position and a fully retracted position, said fully extended position defining a "top" position of the table, said fully retracted position defining a "bottom" position of the table, each of said first and second telescopic columns further comprising a hinge tightening means for tightening said first and second hinge respectively when said table is in the "bottom" position, each of said columns also comprising a stopper means for engagement with the respective support base and preventing any movement of said columns in said respective support support bases when said table is in the "top" position, a system of flexible tension links, said system having a first flexible link and a second flexible link, said first flexible link extending between said bottom base and a point about said second midpoint of the top panel, said second flexible link extending between said bottom base and a point about said fourth midpoint of the top panel, and a tensioning means for applying tension to said system of flexible tension links in any position of the top panel.

2. The table as defined in claim 1, wherein said hinge tightening means comprising a threaded pin, capable of being tightened by hand.

3. The table as in claim 1, wherein said stopper means comprising a spring-loaded pin.

4. The table as defined in claim 1, wherein said tensioning means comprising a barbed rod extending from said bottom base and a pulley, said pulley slidably engaged with both the first and the second flexible links and containing an opening for sliding over said barbed rod, said pulley being disengaged with the barbed rod in the "top" position of the table and being engaged with said barbed rod in the "bottom" or tilted position of said table.

5. The table as in claim 4, wherein said barbed rod further comprising at least one row of manually releasable barbs for retaining said pulley over said barbed rod.

6. The table as in claim 4, wherein said barbed rod is hingedly attached to said bottom base, whereby said barbed rod can be tilted away when not in use.

7. The table as defined in claim 1, wherein each of said first and second flexible tension links comprising a pair of end loops being capable of individually disengaging from said top panel for tilting said table while in the "top" position.

8. The table as in claim 1, further comprising at least one storage tray of a magnetic material said tray being removably retained next to said top panel by a permanent magnet attached under said top panel along one of the sides.

* * * * *